US006003169A

United States Patent [19]

Davis, Jr.

[11] Patent Number: 6,003,169

[45] Date of Patent: Dec. 21, 1999

[54] SOLID SURFACE SHOWER PAN

[75] Inventor: Thomas A. Davis, Jr., Savannah, Ga.

[73] Assignee: Davis Systems, Inc., Savannah, Ga.

[21] Appl. No.: 09/150,140

[22] Filed: Sep. 9, 1998

[51] Int. Cl.[6] ..... A47K 3/22

[52] U.S. Cl. ..... 4/613; 4/584; 52/34

[58] Field of Search ..... 4/612–614, 584, 4/593; 52/34, 35

[56] References Cited

U.S. PATENT DOCUMENTS

| | | | |
|---|---|---|---|
| 2,836,830 | 6/1958 | Norman | 4/613 |
| 3,363,267 | 1/1968 | Kaiser et al. | 4/613 |
| 3,501,879 | 3/1970 | Mitchell et al. | 4/612 X |
| 3,606,617 | 9/1971 | Frazier | 4/613 |
| 4,316,295 | 2/1982 | Whitney et al. | 4/614 X |
| 4,541,132 | 9/1985 | Long | 4/614 |
| 4,557,004 | 12/1985 | Piana | 4/613 |
| 4,938,825 | 7/1990 | Macdonald | 4/612 X |
| 4,993,201 | 2/1991 | Bunyard | 52/35 |
| 5,115,604 | 5/1992 | Bunyard | 52/34 |
| 5,140,789 | 8/1992 | De Gooyer | 52/71 |
| 5,299,330 | 4/1994 | Moore et al. | 4/612 X |

*Primary Examiner*—Henry J. Recla
*Assistant Examiner*—Kathleen J. Prunner
*Attorney, Agent, or Firm*—Harleston Law Firm; Kathleen M. Harleston

[57] ABSTRACT

A prefabricated, custom-built shower pan with a drain hole for use in a shower stall is provided. The shower pan comprises: (a) an acrylic-based solid surface upper layer; (b) a polystyrene foam layer; and (c) a planar base layer with raised edges, the base layer being durable, rigid and relatively lightweight. The polystyrene foam layer is framed by the base layer and covered by the acrylic-based solid surface upper layer. Also provided is a shower pan comprising: (a) an acrylic-based solid surface upper layer; (b) a base layer comprising a planar base with raised edges, and a system of stringers; and (c) a waterdam. The stringers are substantially straight, horizontal wooden supports which collectively incline toward the drain hole. They are relatively evenly distributed within and adhered to the rectangular-shaped base. Each stringer has an incline on its upper surface, and one end abutting one edge of the base. A strong, durable, easy to clean, easy to install shower pan is provided with an even, graded surface. Novel methods for making these shower pans are also provided.

6 Claims, 3 Drawing Sheets

SOLID SURFACE SHOWER PAN

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

The present invention relates to a pre-fabricated shower pan, with a drain hole, for installation in a shower stall. In particular, the invention relates to a novel, customized shower base with an acrylic-based solid surface top which incorporates the mold used in its construction.

2. Background Information

There are various types of shower pans and shower stall panels available for purchase and installation in the bathrooms of new or renovated residences or other types of buildings. A contractor or homeowner ordinarily blocks out shower measurements during construction and later installs a shower pan and finishes shower walls. The walls of the shower may be pre-fabricated or the homeowner, contractor or subcontractor may, for example, install back boards and tile the walls, or he or she may install natural or cultured synthetic marble shower walls. Similarly, the bottom of the shower may be made of tile, marble, etc. in the house by the subcontractor, or it may be custom-built to the contractor's specifications and shipped or carried to the house.

Contractors and homeowners often custom order a shower pan according to the specifications in the particular home under construction. The contractors/homeowners provide specific length and width measurements, as well as a measurement for the position of the drain hole in the shower pan, for customized pre-fabrication of the shower pan. Most shower pans cannot be made in a standardized manner because each bathroom under construction has its peculiarities. Often, for example, the drain hole must be placed off-center because of the location of joists and pipes in that particular bathroom. The shower pan must be properly graded to slope down toward the drainhole, which is made more difficult by an off-center drainhole.

Presently, shower pans are frequently built using large wooden molds, which are relatively expensive to build and which are difficult to adapt to each new set of specifications. The present shower pan can be custom built without a separate mold. This is because a support system is built into the shower pan of the present invention. The result is a one-piece, relatively lightweight, durable shower pan which is easy to ship. Presently available custom-built shower pans often have bowing toward the center of several of the four edges, leaving a bow-shaped space to be filled in by the contractor (or homeowner) installing the shower panels. Another frequent problem for the on-site contractor is that one side of presently available pans is often slightly lower than the other. When a shower panel is inserted along the edge of such a pan, a gap is left at the top of the shower panel. The on-site contractor must spend extra time filling in these gaps. With the shower pan of the present invention, bowing and gaps are virtually eliminated because these pans are easier to shape and can be consistently manufactured. Even where the drain hole is off-center, the surface of the present shower pan is properly and easily graded so that water flows to the drain hole when the pan is installed.

Once they are built, many currently available shower pans are difficult to clean. Mold and mildew collect in shower stalls and the gray-green stains they leave are often difficult to remove. Residue from hard water can present a more challenging cleaning problem because the residue collects in the shower pan and attracts dirt.

The shower pan of the present invention is easy to clean, and it collects less dirt, mold and mildew. The surface of the present shower pan can also be sanded periodically by the user, producing a clean, like-new surface. The present shower pan is water repellent, capable of supporting body weight, and it should last for years. During manufacture, no reusable base mold is needed. The manufacturing process for the present shower pan, which includes thermoforming an acrylic-based solid surface to the top, is less time consuming and more sensitive to manufacturing specifications.

BRIEF SUMMARY OF THE INVENTION

The present invention is a prefabricated shower pan with a drain hole for use in a shower stall. The shower pan comprises: (a) an acrylic-based solid surface upper layer; (b) a polystyrene foam layer; and (c) a planar base layer with raised edges, the base layer being durable, rigid and relatively lightweight. The polystyrene foam layer is framed by the base layer and covered by the acrylic-based solid surface upper layer. Also provided is a shower pan comprising: (a) an acrylic-based solid surface upper layer; (b) a base layer comprising a planar base with raised edges, and a system of stringers; and (c) a waterdam. The stringers are substantially straight, horizontal wooden supports which collectively incline toward the drain hole. They are relatively evenly distributed within and adhered to the rectangular-shaped base. Each stringer has an incline on its upper surface, and one end abutting one edge of the base. A strong, durable, easy to clean, easy to install shower pan is provided with an even, graded surface. Novel methods for making these shower pans are also provided.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
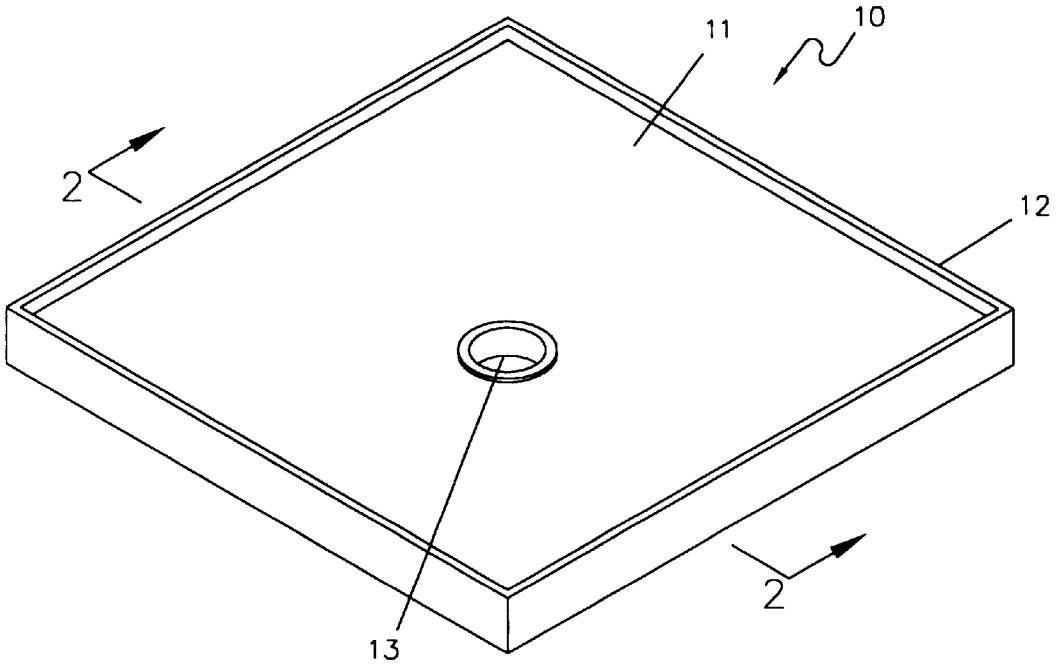
FIG. 1 is a perspective view of a shower pan according to the present invention.

In the following description, like reference characters designate like or corresponding parts throughout the several views. Also, in the following description, it is to be understood that such terms as "top," "bottom," "within," and the like are words of convenience and are not to be construed as limiting terms. Referring in more detail to the drawings, the invention will now be described.

Referring to FIG. 1, a shower pan 10 which forms the floor of a shower stall has an acrylic-based solid surface layer 11 on top. Around the four edges of the shower pan 10 is a waterdam 12, which is attached to and surrounds the shower pan 10. The top surface of the shower pan 10 is relatively evenly graded so that the surface gradually slopes toward a drain hole 13. This is so that water will run down to the drain once it is in service. A metal or other standard type of drain 14 is shown in the drain hole 13.

Figure 2:
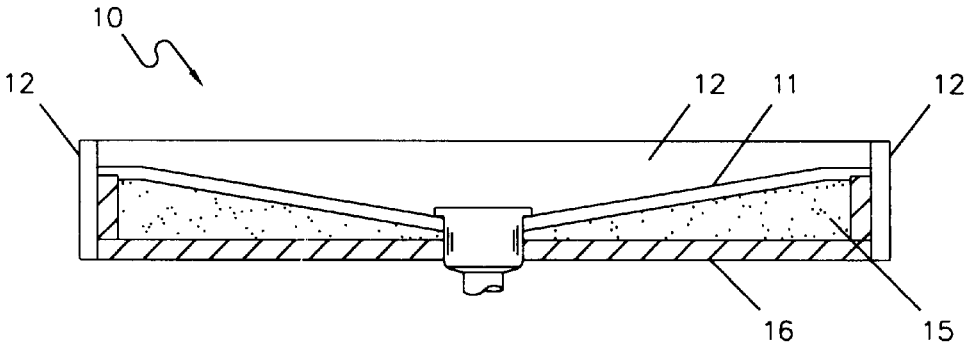
FIG. 2 is a sectional view taken along line 2—2 of FIG. 1.
Figure 3:
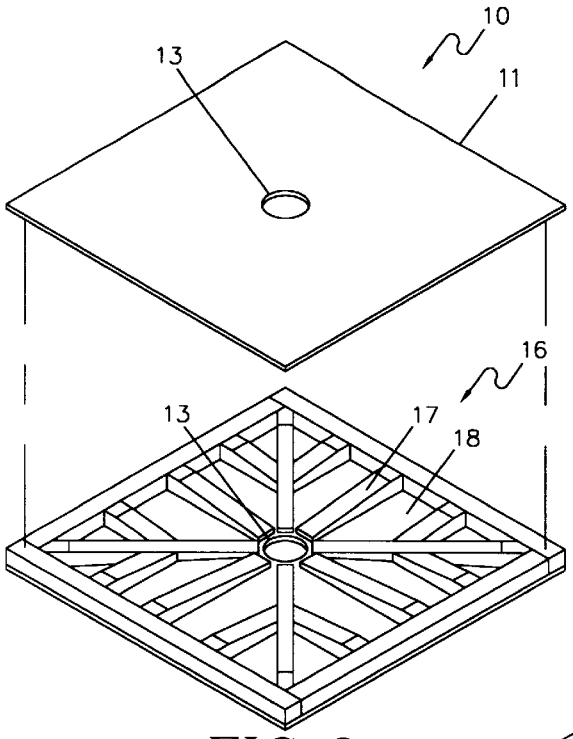
FIG. 3 is a perspective view of an alternate embodiment of a shower pan according to the present invention, with the solid surface top layer shown detached.
Figure 4:
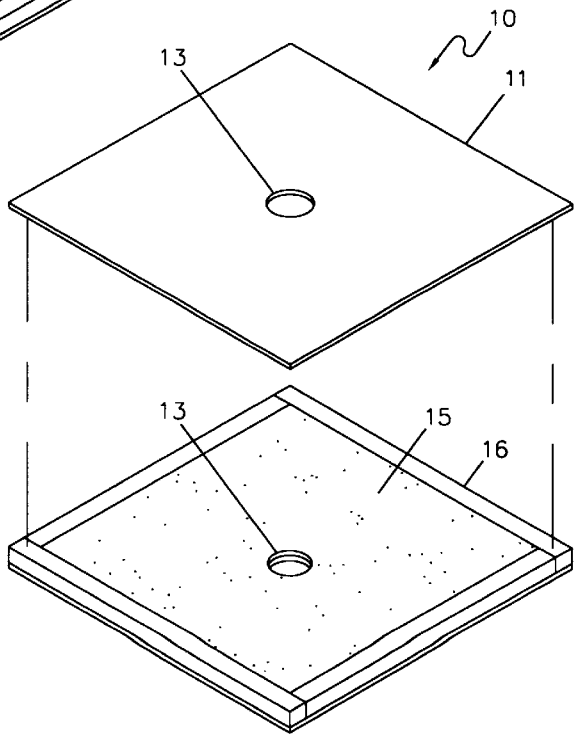
FIG. 4 is a perspective view of the shower pan shown in FIG. 2, with the solid surface layer shown detached.
Figure 5:
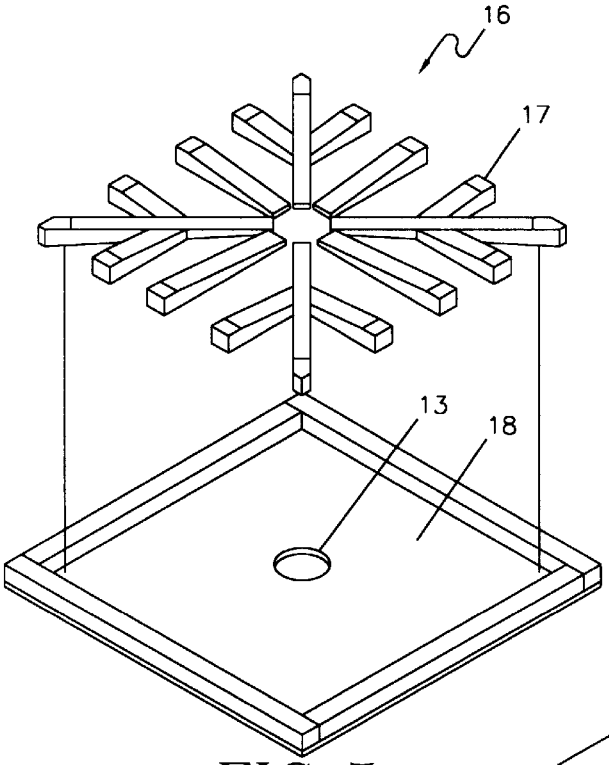
FIG. 5 is a perspective view of the base mold layer of the shower pan of FIG. 3.
Figure 6:
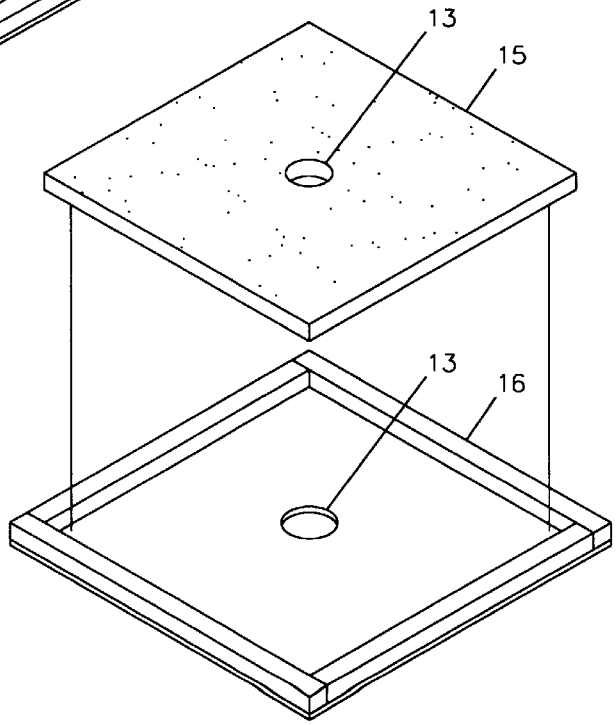
FIG. 6 is a perspective view of the shower pan of FIG. 4, with the polystyrene foam layer shown detached.

FIG. 2 is a cross-section of FIG. 1 along line 2—2 immediately next to the drain 14. In the background and along the sides, the relatively thin waterdam 12 can be seen. There are at least two embodiments of the present invention, which differ from each other below the surface (top layer). The first is a three-layer shower pan, with the acrylic-based solid surface layer 11 on top, a polystyrene foam layer 15 in the middle, and a base layer 16 of any suitable durable, strong, relatively lightweight material or combination of materials. The first embodiment is shown in FIGS. 2, 4 and 6. The second embodiment includes the acrylic-based solid surface layer 11 on top and a base layer 16 with a stringer system as shown in FIGS. 3 and 5. Either embodiment can have the appearance of FIG. 1, depending on the particular specifications of the pan. The base layer 16 of the shower pan forms a support for the other layers. The base layer 16 is preferably substantially made of wood. In this invention, the mold is in effect provided within the shower pan. In the first embodiment, the base layer combined with the polystyrene foam layer provides the mold, or template. In the second embodiment, the base layer provides the mold.

Ordinarily in the manufacture of pre-fabricated shower pans, a large, removable, reusable, wooden mold is employed. The shower pan is formed on the mold, and then the mold is removed and can be used to build another pan. Since the mold can be somewhat expensive to make, a single mold is often built for use as a template for several different sized shower pans. Unless the specifications for the shower pan to be built happen to mirror the specifications of the reusable mold, it is difficult to make a shower pan exactly according to specs with flat edges and a gradual slope toward the drain. Many shower pans, for example, end up with seams on the surface. There are often four scams in the approximate shape of a cross, with the drain hole roughly in the center of the cross-shape. These seams, or indentations, match the seams of the mold, which is usually in four segments (like puzzle pieces) which are elevated at the outer edges to provide the necessary slope. These reusable molds can be clumsy to use. A separate mold is not required for the present invention, which has its own built-in mold. The present shower pan does not have scams and its edges are less likely to be bowed or buckled than the models built using a large reusable mold. The shower pan of the present invention has a relatively even, gradual slope, even where the dimensions are not perfectly square and the drain hole is off center.

The location of pipes, joists and showers varies between bathrooms. The specifications for shower pans therefore also vary. The required location of drain holes in shower pans quite often varies depending upon where the pipes are placed in a home. It is easier to customize construction of shower pans with the present invention versus the reusable-mold construction because in the present invention each base layer is built to spec. During manufacture of a shower pan according to the present invention, the location of the drain hole (according to the specification) is marked on the base and the stringer system is designed to slope toward that drain hole location. No large, reusable mold is necessary or desirable in the present invention; the layers that form the shower pan itself suffice.

As shown in FIG. 2, the middle layer is the polystyrene foam layer 15, which is preferably extruded polystyrene foam. The polystyrene foam layer 15 has been graded so that the surface of the shower pan has an incline of between about ⅛ and ½, most preferably ¼, inch drop per foot of surface. The incline begins between about ½ and 2 inches from the edges of the shower pan and ends in close proximity to the drain hole. This is believed to be novel, and serves a purpose: to minimize bowing and buckling from an uneven fit with the walls of the shower stall once it is installed. In this first embodiment, the bottom two layers are formed first. The extruded foam is distributed in the base frame. This is how the relatively uniform, even slope to the drain is achieved in the first embodiment: the polystyrene foam layer is graded and shaped before the solid surface top layer is added. The upper acrylic-based solid surface layer 11 is then thermoformed to fit the polystyrene foam layer beneath. The surface therefore assumes the grade of the foam layer.

In FIG. 3, the second embodiment of the present invention is shown. The solid surface top layer 11 is shown detached from the bottom layer 16. Each layer is shown with a drain hole 13. In this second embodiment, the middle polystyrene foam layer 15 is optional because support for the upper solid surface layer 11 is formed by a system of stringers 17. The base layer comprises a planar base 18 with raised edges, and the stringers 17.

In FIG. 4, the first embodiment is shown. The solid surface layer 11 is shown detached from the base layer 16. Each layer is shown with a drain hole 13. The polystyrene foam layer 15 is shown in the rigid base layer 16.

In FIG. 5, the base layer 16 of the second embodiment is shown. The system of stringers 17 is shown detached from the planar base frame 18.

In FIG. 6, the bottom two layers of the first embodiment are shown. For purposes of visualization, the polystyrene foam layer 15 is shown detached from the base layer 16.

Shower Pan

In summary: the first embodiment is a prefabricated shower pan with a drain hole for use in a shower stall. It comprises:

(a) a solid surface upper layer. An acrylic-based solid surface material is preferred.

(b) a polystyrene foam layer; and (c) a planar base layer with raised edges, the base layer being durable, rigid and relatively lightweight. The surface of the shower pan has a slope which inclines gradually toward the drain hole, and the surface is relatively even and uniform, and does not include seams. The polystyrene foam layer is framed by the base layer and covered by the acrylicbased solid surface upper layer. The shower pan is rectangular in shape and capable of supporting the weight of up to three people.

Preferably, the acrylic-based solid surface layer is next to and on top of the polystyrene foam layer, the polystyrene foam layer is next to and supported by the base layer, and the polystyrene foam layer lies between the acrylic-based solid surface layer and the base layer. Preferably, the shower pan further comprises a waterdam, which is attached to and surrounds the shower pan.

Preferably, the base layer comprises a system of substantially straight, horizontal wooden support stringers which collectively incline toward the drain hole. The stringers are relatively evenly distributed within and adhered to a rectangular-shaped base. Each stringer has an incline on its upper surface, and one end abutting one edge of the base. The stringers are of approximately the same width at the end which abuts the edge of the base. Preferably, the surface layer has an even outer (peripheral) area along each side adjacent to the waterdam which is not graded, the peripheral area being between about ½ and two inches in width.

The second embodiment is a prefabricated shower pan with a drain hole for use in a shower stall. It comprises:

(a) an acrylic-based solid surface upper layer;

(b) a base layer comprising a planar base with raised edges, and a system of stringers; and (c) a waterdam, the waterdam being attached to and surrounding the solid surface layer and the base layer. The base is durable, rigid and relatively lightweight and approximately the dimensions of the shower pan. The stringers are substantially straight, horizontal wooden supports which collectively incline toward the drain hole. The stringers are relatively evenly distributed within and adhered to a rectangular-shaped base. Each stringer has an incline on its upper surface, and has one end abutting an edge of the base. The stringers are of approximately the same width at the end which abuts the edges of the base. The solid surface layer is the surface of the shower pan and lies on top of and next to the base layer, which forms the bottom of the shower pan. The surface of the shower pan has a slope which inclines gradually toward the drain hole, and the surface of the shower pan is relatively even and uniform, and does not include scams. The shower pan is rectangular in shape and capable of supporting the weight of up to three people.

Preferably, the pan further comprises a layer of polystyrene foam between the upper acrylic-based solid surface and the base. The surface of the acrylic-based solid surface preferably has an even outer peripheral area along each side adjacent to the waterdam which is not graded, the peripheral area being between about ½ and two inches in width.

The waterdam 12 is added once the shower pan has been manufactured by gluing the four edges of the waterdam onto the edges of the pan and fiberglassing the corners of the waterdam. The primary purpose of the waterdam is to prevent water from escaping the pan during showers.

Prior to manufacture, the purchaser provides dimensions to the manufacturer for the length, width and location of the drain hole. After the shower pan is manufactured to the specifications (i.e., customized, yet pre-fabricated), it is shipped to the purchaser. The purchaser places the pan in the appropriate prepared location in the bathroom and installs the drain. Shower panels can then be placed one at a time inside the waterdam along each edge of the shower pan, or the shower walls can be tiled, marbled, etc. Applicant found that if the edges of the shower pan remain flat for approximately 1–2 inches before the incline in the surface begins, there is ordinarily no need for filling in uneven places along the bottom of the shower panels once they are placed. This is done in the present invention.

The present shower pan has few irregularities to gather dirt, mold and mildew. However, if hard water stains do become a problem, the homeowner can use sand paper to sand the acrylic-based solid surface of the present invention every six months or so to achieve a clean white surface.

Method

Also included in the present invention are alternate methods for making a prefabricated shower pan with a drain hole, surprisingly without using a separate, removable, reusable mold. The first involves grading and shaping a polystyrene foam layer to provide a template to which the solid surface top is thermoformed. See FIGS. 2, 4, and 6. The second involves use of inclined stringers which provide the template to which the solid surface top conforms. See FIGS. 3 and 5. Either way, a strong, durable, easy to clean, easy to install shower pan is provided with an even, graded surface.

The first method comprises the following steps:

(a) constructing a planar base 16 frame of treated lumber. A rectangular-shaped, flat piece of treated plywood is normally used. Pieces of ¾ inch plywood are nailed along the four sides to form a frame.

(b) distributing extruded polystyrene foam in the area within the base layer frame so that the area is filled with the foam. This polystyrene foam layer 15 is allowed to dry at room temperature. After trying different materials, this material has been found to be particularly well-suited for the present invention because it spreads easily, dries quickly, is relatively inexpensive and lightweight, and it can be uniformly graded.

(c) cutting the drain hole 13 into the polystyrene foam/base product of steps (a) and (b). The drain hole must be cut according to the specifications, which are most often provided by the homeowner or building contractor. It is normally between about 7 and 9 inches in diameter, but it is commonly off-center.

(d) grading and shaping the polystyrene foam layer 15 into a relatively uniform, gradual downward incline toward the drain hole. The grading begins between about ½ and 2 inches from the edges of the shower pan. This is believed to be novel. Its purpose is to increase the likelihood that the shower pan will fit in the shower stall once it is fabricated (see above).

(e) fitting an acrylic-based solid surface 11 on the polystyrene foam/base product 15, 16. A solid surface top layment is preferably used to measure and fit the acrylic-based solid surface to the polystyrene foam/base product.

(f) cutting the drain hole 13 in the acrylic-based solid surface to match the drain hole in the polystyrene foam/base product;

(g) heating the acrylic-based solid surface 11 in an oven until it is conformable. The solid surface is being thermoformed to the substrate, which is the graded polystyrene foam. The foam and base layers were earlier formed into one product (intermediate) by steps (a) and (b).

(h) placing the heated acrylic-based solid surface 11 on the polystyrene foam/base product 15, 16;

(i) distributing a number of weights relatively evenly over the acrylic-based solid surface before it cools;

(j) allowing the acrylic-based solid surface/polystyrene foam/base product 15, 16 of step (h) to cool at room temperature; and (k) gluing the acrylic-based solid surface 11 to the polystyrene foam/base product 15, 16 to form a shower pan.

Preferably:

the grading is between about ⅛ and ½ inch drop per foot, and begins between about ½ and 2 inches from the edges of the shower pan and ends in close proximity to the drain hole.

a solid surface top layment is used to measure and fit the acrylic-based solid surface to the polystyrene foam/base product.

after step (h), insert the step of: seaming the solid surface to the bottom of the drain hole. This is done to prevent separation of the layers and improve fit at the drain hole.

step (g) heating is in a convection oven at between about 320 and 330 degrees Fahrenheit for between about 35 and 60 minutes.

after step (f), insert the step of: covering the polystyrene foam/base product with a protective sheeting before adding the heated acrylic-based solid surface. It was found that when the acrylic-based solid surface was hot enough to thermoform to the polystyrene foam/base product, it was unfortunately melting or adhering to the polystyrene foam/base product. This problem was solved by placing a heat-resistant protective sheeting over the polystyrene foam/base product before placing the heated solid surface on top.

after step (h), insert the step of: clamping the edges of the heated acrylic-based solid surface to the polystyrene foam/base product. It was found that the edges of this novel combination of layers: base mold, foam, and acrylic-based solid surface, were detaching after the solid surface cooled, forming an unacceptable shower pan. After various solutions were tried and failed, it was found that a flat plane is formed by clamping the edges of the layers together while the solid surface is still warm.

after step (I), insert the step of: gluing a waterdam onto the four edges of the shower pan.

The alternate second method for making a prefabricated, rectangular-shaped shower pan with a drain hole without using a separate, removable, reusable mold, comprises the following steps:

(a) constructing a base layer 16 of treated lumber, by attaching a number of substantially straight, separate, horizontal, wooden support stringers 17 with an upper inclined surface to a rectangular-shaped, planar wooden base, so that the stringers 17 gradually slope downward toward the drain hole. The stringer system preferably follows the design shown in FIG. 3. The stringers angle towards the drainhole 13. Fach stringer is inclined on top. They are placed in a branching shape, with one end adjacent to the edges of the base frame. These angles depend upon the dimensions specified by the builder or homeowner, particularly placement of the drain hole and the lengths of the shower pan sides. The base layer 16 preferably comprises the planar base 18 and the stringers 17.

(b) fitting an acrylic-based solid surface 11 on the base layer;

(c) cutting the drain hole 13 in the base layer 16 and the acrylic-based solid surface layer 11;

(d) heating the acrylic-based solid surface layer 11 in an oven to a conformable state. This is preferably done in a convection oven which has been preheated to between about 320 and 330, most preferably about 325, degrees Fahrenheit. The solid surface is removed from the oven after between about 35 and 60, most preferably about 45, minutes. If the acrylic-containing solid surface is much hotter or cooler than this, it may not thermoform (conform) properly to the polystyrene foam/base product (the intermediate).

(e) placing the heated acrylic-based solid surface layer 11 on the base layer 16. The drain hole 13 of the two layers should be centered over each other.

(f) distributing a number of weights relatively evenly over the acrylic-based solid surface layer before it cools. It was found that the solid surface top layer was likely to rise up during cooling; the solid surface was not conforming to the downward incline of the foam layer below it. This resulted in an unacceptable product. This problem was best solved by placing a number of molding bags, most preferably between about three and six small sand bags, on the top of the solid surface during the cooling process. The product (the solid surface on top of the polystyrene foam/base product) is allowed to cool to room temperature.

(g) allowing the acrylic-based solid surface layer 11 to cool at room temperature;

(h) gluing the acrylic-based solid surface layer 11 to the base layer 16-using a suitable adhesive. Care should be exercised to center the drain hole of the solid surface layer over the drain hole in the polystyrene foam/base product.

(i) adhering (preferably gluing, using a suitable adhesive) a waterdam 12 to the edges of the layers to form the shower pan. The waterdam, usually fiberglas, prevents water from flowing over the edges of the shower pan when it is in use.

The preferred method further comprises the following steps after step (a): distributing extruded polystyrene foam between and on the stringers of the base layer, and grading and shaping the polystyrene foam layer into a relatively uniform, gradual downward incline toward the drain hole. The grading preferably creates an incline of between about ⅛ and ½, most preferably ¼, inch drop per foot of surface.

The stringers are preferably inclined to provide a grade of between about ⅛ and ½ inch drop per foot. The grading, or incline, ends in close proximity to the drain hole, preferably between about ⅛ and ½ inch from the edge of the drain hole so that the drain will fit well once it is placed in the drain hole.

A particularly preferred embodiment of the present invention is made by the following steps:

STEP #1: Construct a treated lumber frame with a ¾ inch treated plywood substrate. Fill the frame with extruded polystyrene foam.

STEP #2: Mark and cut an 8 inch hole for a shower base drain including room for the drain build-up.

STEP #3: Beginning approximately 1 inch from the edge of the pan, grade the polystyrene foam in a ¼ inch drop per foot toward the drain hole. The grade marks are used to indicate the grade for step #4.

STEP #4: Shape the polystyrene foam to provide a uniform slope to the drain.

STEP #5: Using a solid surface top layment, measure and fit an acrylic-based solid surface to the polystyrene foam/support system.

STEP #6: Cut a drain hole in the solid surface, and seam the solid surface build-up support to the bottom of the drain hole.

STEP #7: Place the solid surface shower base top thus formed in a convection oven set at approximately 325 degrees for about 45 minutes.

STEP #8: Cover the polystyrene foam/support system with plastic or other type of sheeting to prevent the heated solid surface top from melting or adhering to the polystyrene foam.

STEP #9: Remove the solid surface top from the oven, and place it on the covered polystyrene foam/support system. All edges must be clamped so that a flat plane is formed during the cooling process. Place molding bags, most preferably sand bags, on the top of the solid surface in order to keep the grade during the cooling process. The solid surface is likely to rise up during cooling if step #9 is not followed.

STEP #10: After the solid surface has completely cooled and formed to the shaped polystyrene foam/support system, glue the solid surface top to the polystyrene foam/support system using a suitable adhesive, being sure to center the drain hole according to specifications.

While preferred embodiments of the invention have been described using specific terms, this description is for illustrative purposes only. It will be apparent to those of ordinary skill in the art that various modifications may be made without departing from the spirit or scope of the invention, and that such modifications arc intended to be within the scope of the present invention.

What is claimed is:

1. A prefabricated shower pan with a drain hole for use in a shower stall, the shower pan comprising:

(a) an acrylic-based solid surface upper layer;

(b) a polystyrene foam layer; and (c) a planar base layer with raised edges, the base layer being durable, rigid and relatively lightweight wherein the base layer comprises a system of substantially straight, horizontal wooden support stringers which collectively incline toward the drain hole, the stringers being relatively evenly distributed within and adhered to a rectangular-shaped base, each stringer having an incline on its upper surface, each stringer having one end abutting one edge of the base, and the stringers being of approximately the same width at the end which abuts the edge of the base; and wherein the surface of the shower pan has a slope which inclines gradually toward the drain hole, and wherein the surface of the shower pan is relatively even and uniform, and does not include seams;

wherein the polystyrene foam layer is framed by the base layer and covered by the acrylic-based solid surface upper layer; and wherein the shower pan is rectangular in shape and capable of supporting the weight of up to three people.

2. A device according to claim 1, wherein the acrylic-based solid surface layer is next to and on top of the polystyrene foam layer, the polystyrene foam layer is extruded, next to and supported by the base layer, and the polystyrene foam layer lies between the acrylic-based solid surface layer and the base layer.

3. A device according to claim 2, wherein the shower pan further comprises a waterdam, the waterdam being attached to and surrounding the shower pan.

4. A device according to claim 3, wherein the surface layer has an even outer peripheral area along each side adjacent to the waterdam which is not graded, the peripheral area being between about ½ and two inches in width.

5. A prefabricated shower pan with a drain hole for use in a shower stall, the shower pan comprising:

(a) an acrylic-based solid surface upper layer;

(b) a base layer comprising a planar base with raised edges, and a system of stringers; and (c) a waterdam, the waterdam being attached to and surrounding the solid surface layer and the base layer;

(d) a layer of polystyrene foam between the upper acrylic-based solid surface and the base; and wherein the base is durable, rigid and relatively lightweight, rectangularly-shaped and approximately the dimensions of the shower pan;

wherein the stringers are substantially straight, horizontal wooden supports which collectively incline toward the drain hole, the stringers being relatively evenly distributed within and adhered to the rectangular-shaped base, each stringer having an incline on its upper surface, each stringer having one end abutting one edge of the base, and the stringers being of approximately the same width at the end which abuts the edge of the base;

wherein the solid surface layer is the surface of the shower pan and lies on top of and next to the base layer, which forms the bottom of the shower pan;

wherein the surface of the shower pan has a slope which inclines gradually toward the drain hole, and wherein the surface of the shower pan is relatively even and uniform, and does not include seams; and wherein the shower pan is rectangular in shape and capable of supporting the weight of up to three people.

6. A device according to claim 5, wherein the surface of the acrylic-based solid surface has an even outer peripheral area along each side adjacent to the waterdam which is not graded, the peripheral area being between about ½ and two inches in width.

* * * * *